United States Patent [19]

Bonvallet

[11] Patent Number: 4,491,099

[45] Date of Patent: Jan. 1, 1985

[54] HYPOCYCLIC ROLLING CONTACT ROCKER ARM AND PIVOT FOR AN INTERNAL COMBUSTION ENGINE

[75] Inventor: Duane J. Bonvallet, Ann Arbor, Mich.

[73] Assignee: General Motors Corporation, Detroit, Mich.

[21] Appl. No.: 531,269

[22] Filed: Sep. 12, 1983

Related U.S. Application Data

[63] Continuation-in-part of Ser. No. 496,930, May 23, 1983.

[51] Int. Cl.[3] ..... F01L 1/18

[52] U.S. Cl. ..... 123/90.44; 123/90.27; 123/90.41

[58] Field of Search ..... 123/90.39, 90.41, 90.42, 123/90.27, 90.44

[56] References Cited

U.S. PATENT DOCUMENTS

| | | | |
|---|---|---|---|
| 1,497,451 | 6/1924 | Kytlica | 123/90.41 X |
| 2,624,171 | 1/1953 | Kollsman | 123/90.27 X |
| 4,393,820 | 7/1983 | Maki et al. | 123/90.41 |

FOREIGN PATENT DOCUMENTS

| | | | |
|---|---|---|---|
| 2082266 | 3/1982 | United Kingdom | 123/90.39 |

*Primary Examiner*—Michael Koczo
*Assistant Examiner*—Peggy A. Neils
*Attorney, Agent, or Firm*—Arthur N. Krein

[57] ABSTRACT

A valve train for a reciprocating internal combustion engine has a fulcrum means and a rocker arm that define a pair of cooperating outer and inner cylindrical bearing surface contours, respectively, for carrying the reaction forces of rocker arm pivotal movement, the radius of the outer conformation being substantially two times the radius of the inner conformation, with the center of revolution of the outer conformation being located on the operating axis of the valve, the inner conformation of the rocker arm being located such that an extension thereof will intersect the contact point of the rocker arm on the axis of the valve at the free end thereof or on a lifter positioned between the rocker arm and valve. Restrainer means are provided to anchor the cooperating cylindrical conformations for substantially rolling action in relation to each other. The rocker arm, when used in an overhead cam engine, also carries a cam follower roller rotating about an axis located as on an extension of the inner conformation and, this axis and the axis of rotation of the camshaft being on a line that intersects the center of revolution of the outer conformation.

4 Claims, 7 Drawing Figures

HYPOCYCLIC ROLLING CONTACT ROCKER ARM AND PIVOT FOR AN INTERNAL COMBUSTION ENGINE

FIELD OF THE INVENTION

This application is a continuation-in-part of copending application Ser. No. 496,930, filed May 23, 1983 and assigned to the same assignee.

This invention relates to valve trains for internal combustion engines and, in particular, to a hypocyclic rolling contact rocker arm and pivot assembly for use in such valve trains in conventional and also overhead cam engines.

DESCRIPTION OF THE PRIOR ART

Conventional rocker arm and pivot assemblies, as normally used in passenger vehicle type engine valve trains, for example, as used in an overhead valve push-rod type actuated valve train, include a pedestal mounted rocker arm which generally has a spherical or part cylindrical pivot or fulcrum that provide essentially large bearing surfaces. With such an arrangement, the rocker arm is actually in sliding engagement relative to its associate fulcrum and, thus even though these elements may be adequately lubricated, this type arrangement still provides a large area for frictional resistance so as to produce a heat build-up as a result of the loads being applied to the respective bearing surfaces.

The desirability to overcome the above problem has been recognized and, accordingly, various specially constructed or non-production, in terms of passenger vehicle usage, type rocker arm assemblies have been proposed. Such specially constructed or non-production type rocker arm assemblies have been used in special engine applications, as for example, in engines of race cars. Thus in such specialized engine applications, in order to reduce friction, roller bearing assemblies have been used to pivotally support a rocker arm. Such roller bearing assemblies are mounted, for example, on stub shafts secured to a fulcrum in a manner whereby to pivotably support an associate rocker arm in a manner similar to that shown, for example, in U.S. Pat. No. 3,621,823, entitled Frictionless Rocker Arm Fulcrum Assembly, issued Nov. 23, 1971 to John Lombardi.

It is readily apparent that such a rocker arm and its associate pivot assembly which includes one or more roller bearing assemblies is far more complex and expensive, from a production standpoint, to use in conventional passenger vehicle engines.

It has also been proposed to provide a rocker arm and pivot arrangement such that the rocker arm is claimed to be movable about a support in rolling motion in a manner shown, for example, in U.S. Pat. No. 2,943,612 entitled Value Gear which issued on July 5, 1960 to Alexander G. Middler as an improvement over the rocker arm pivot structure shown in U.S. Pat. No. 1,497,451 entitled Rocker Arm issued June 10, 1924 to John F. Kytlica. However, it will be apparent that the rolling contact between the rocker arm and pivot of this U.S. Pat. No. 2,943,612 patent teaching is comparable to that of a cylinder rolling on a flat or substantially flat surface.

As a further improvement there has been disclosed in United States patent application Ser. No. 356,926, filed Mar. 10, 1982 in the names of Emil R. Maki; Ferdinand Freudenstein; Raymond L. Richard, Jr., and Meng-Sang Chew, a rolling contact rocker arm and pivot assembly that includes a rocker arm with a semi-cylindrical bearing surface intermediate its ends and an associate fixed pivot member having a semi-cylindrical fulcrum bearing surface, the ratio of the radii of these surfaces being on the order of 3:1 to 1.7:1 and preferably 2:1 to provide for cardanic motion. In this assembly, one of the bearing surfaces is provided with a guide recess or slot therein of a size and shape so as to receive in substantially rolling contact a raised retainer pin provided on the other bearing surface, the slot and retainer being located intermediate the arcuate ends of the respective bearing surface.

SUMMARY OF THE INVENTION

A primary object of the present invention is to provide an improved rocker arm and pivot assembly wherein an otherwise conventional type rocker arm and its fixed fulcrum are provided with part circular convex and concave bearing surfaces respectively having, a radius relationship of substantially $\frac{1}{2}$R and R, respectively, with these elements being provided with a retainer pin and slot arrangement whereby there is effected substantially rolling or walking contact between all parts relative to each other during pivotable movement of the rocker arm and wherein the center of revolution of the concave surface being located on the operating axis of an associate valve and the point of contact of the rocker arm against the stem of the valve and of the axis of rotation of a cam follower rotatably supported on the rocker arm being located as an arcuate extension of the concave bearing surface so that straight line motion will be imparted to the valve. In addition, as used in an overhead cam engine, the axis of rotation of the cam follower on the rocker and of the camshaft would be in a plane that intersects the center of revolution of the concave surface.

Accordingly, another object of this invention is to provide an improved rocker arm and pivot assembly that is operative so as to impart straight line motion to a valve, the pivot defining a rocker bearing support intermediate the length of the rocker arm, the pivot and the rocker arm defining a pair of cooperative outer and inner semi-cylindrical bearing surface contours carrying the reaction forces of the rocker arm pivotal movement, the radius of the outer conformation being substantially two times the radius of the inner conformation with the center of revolution of the outer conformation being located on the operating axis of the valve, the inner conformation of the rocker arm being located such that an extension thereof will intersect the contact point at one end of the rocker arm on the axis of the valve at the stem end thereof and also the axis of rotation of a cam follower rotatably supported on the opposite end of the rocker arm. The axis of rotation of the cam follower and of an associate camshaft lay in a plane that extends through the center of revolution of the outer conformation. The pivot and rocker arm are provided with associate slot means and retainer means to insure substantially rolling contact between the rocker arm and pivot.

Still another object of this invention is to provide an improved rocker arm and pivot assembly for use in an overhead cam type internal combustion engine which, in operation, is characterized by minimum energy loss to thus maximize fuel efficiency.

A still further object of the present invention is to provide a rocker arm and pivot of the above type which is easy and inexpensive to manufacture, which is reliable in operation, and in other respects suitable for use on production motor vehicle engines.

For a better understanding of the invention, as well as other objects and further features thereof, reference is had to the following detailed description to be read in connection with the accompanying drawings.

DESCRIPTION OF THE FIRST EMBODIMENT

Figure 1:
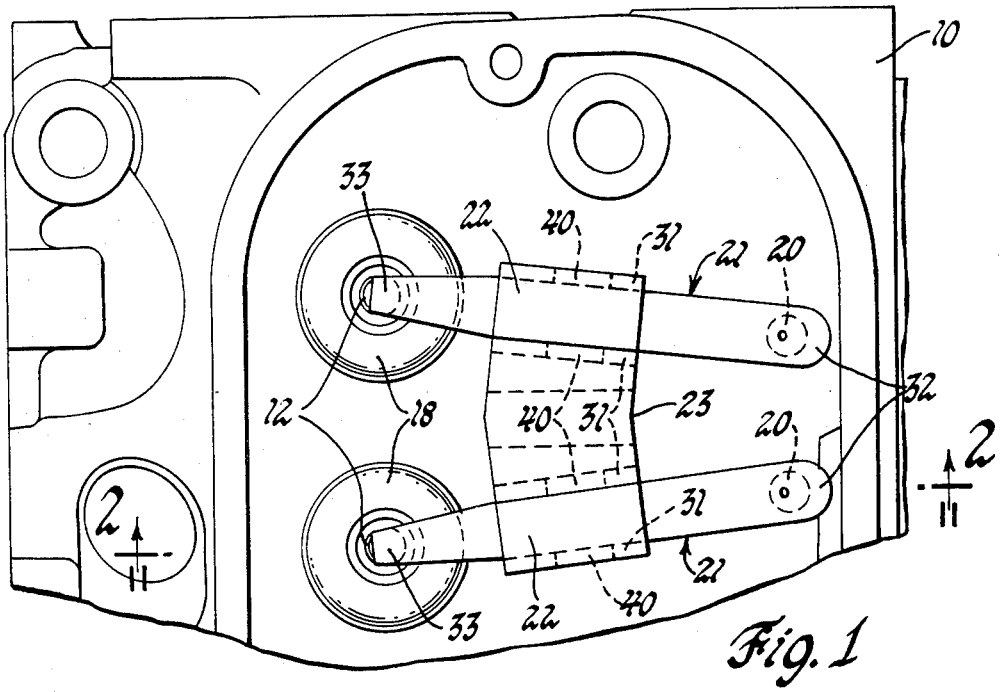
FIG. 1 is a top view of a portion of an internal combustion engine, with the valve cover removed, having valve trains in accordance with the invention incorporated therein.

Referring first to FIG. 1 there is shown a portion of an internal combustion engine, of the conventional overhead valve type, having a cylinder head 10 in which a pair of poppet valves 12 (intake and exhaust) are operatively mounted to control the ingress of a combustion mixture to a cylinder, not shown, of the engine and to control the egress of exhaust gases therefrom. A pair of valve trains, in accordance with the invention, are operatively associated with the valves 12 to effect their operation.

Figure 2:
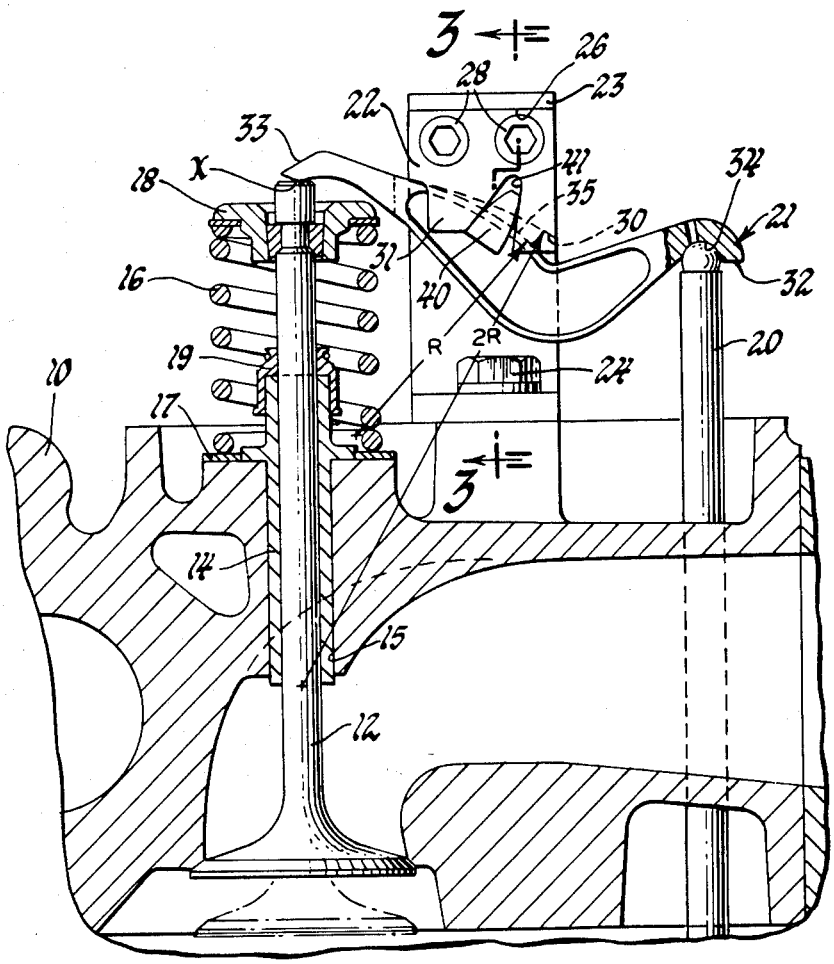
FIG. 2 is a cross-sectional view taken along line 2—2 of FIG. 1 showing a valve train and associate valve, the rocker arm being shown in the valve closed position.

As best seen in FIG. 2, each poppet valve 12 is guided for axial reciprocation in a valve stem guide 14 that is received in a suitable bored opening 15 provided for this purpose in the cylinder head 10, with the upper portion of the poppet valve 12 projecting above the cylinder head. In a conventional manner, the poppet valve 12 is normally maintained in a closed position by a spring 16 encircling the upper portion of the stem of the valve 12, with one end of the spring 16 engaging a washer 17 on the cylinder head 10 and the other end operatively engaging a conventional spring retaining washer assembly 18 secured to the stem of the poppet valve 12 in a conventional manner. A conventional valve stem seal 19 is positioned so as to sealingly engage the stem of the poppet valve.

A push rod 20, which is reciprocably disposed in the cylinder head laterally of the poppet valve 12, has its upper end projecting above the cylinder head 10. As would be conventional, the lower end of the push rod 20 abuts against the upper end of a conventional hydraulic valve tappet, not shown, which operatively engages the cam of a camshaft, not shown, in a conventional manner whereby the push rod is caused to reciprocate, as determined by the profile of the cam on the camshaft, not shown.

Motion of the push rod 20 is imparted to the poppet valve 12 by means of a rocker arm 21 that is pivotably supported by means of a fulcrum 22 fixed to a support member 23 which is rigidly mounted, as by screws 24, to the top of the cylinder head 10 at a suitable location between an associate set of push rods 20 and poppet valves 12.

Figure 3:
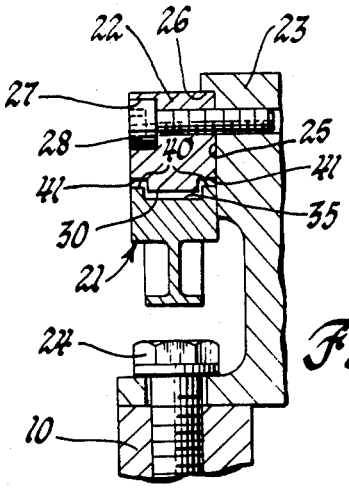
FIG. 3 is a cross-sectional view, taken along line 3—3 of FIG. 2, showing the rocker arm and fulcrum of the valve train assembly.

In the construction shown and as best seen in FIG. 1, the support member 23 is configured so as to support on opposite sides thereof a right hand and a left hand fulcrum 22, for the poppet valves 12 intake and exhaust, respectively associated with a cylinder, not shown, of the engine. In the construction illustrated and as best seen in FIG. 3, each side of the support member 23 is suitably formed so as to provide a vertical support surface 25 and a shoulder 26 at right angles to each other so as to receive an associate fulcrum 22 in a manner whereby to prevent movement of the fulcrum, the right hand fulcrum being shown in FIGS. 2 and 3. Each fulcrum 22 is suitably secured to the support member 23 as by means of screws 28, each of which extends through a stepped bore 27 in the fulcrum so as to be threadingly received in the support member 23.

Since the fulcrums 22 are of similar construction but of opposite hand it is deemed necessary to describe only the right hand fulcrum.

As shown, the right hand fulcrum 22, of inverted U-shape, is provided with a lower semi-cylindrical concave bearing surface 30 of a suitable predetermined radius 2R in the central portion thereof and, in the construction illustrated, with retainer arms 31 depending downward from opposite sides of the bearing surface 30, all for a purpose to be described in detail hereinafter. As previously described, the left hand fulcrum 22 is of the same configuration as the right hand fulcrum 22 but of the opposite hand, that is, to accept the screws 28 in a manner to permit it to be mounted on the opposite side of the support member 23 from the right hand fulcrum.

Since the right hand and left hand rocker arms 21 are also of similar configuration, only the right hand rocker arm 21, illustrated in FIGS. 2 and 3, will be described. This rocker arm 21 is provided with arms 32 and 33 overlying and resting on the upper ends of the associate push rod 20 and poppet valve 12, respectively. As shown in FIG. 2, the bottom surface of the arm 32 is spherically dished as at 34 to socketably receive the upper ball end of the push rod 20. Between the arms 32 and 33, the rocker arm 21 is provided with an upper, intermediate, semi-cylindrical convex bearing surface 35 of a radius R. As best seen in FIG. 3, the width of this bearing surface 35 is formed complimentary to the width of the bearing surface 30 for suitable engagement therewith.

Figure 4:
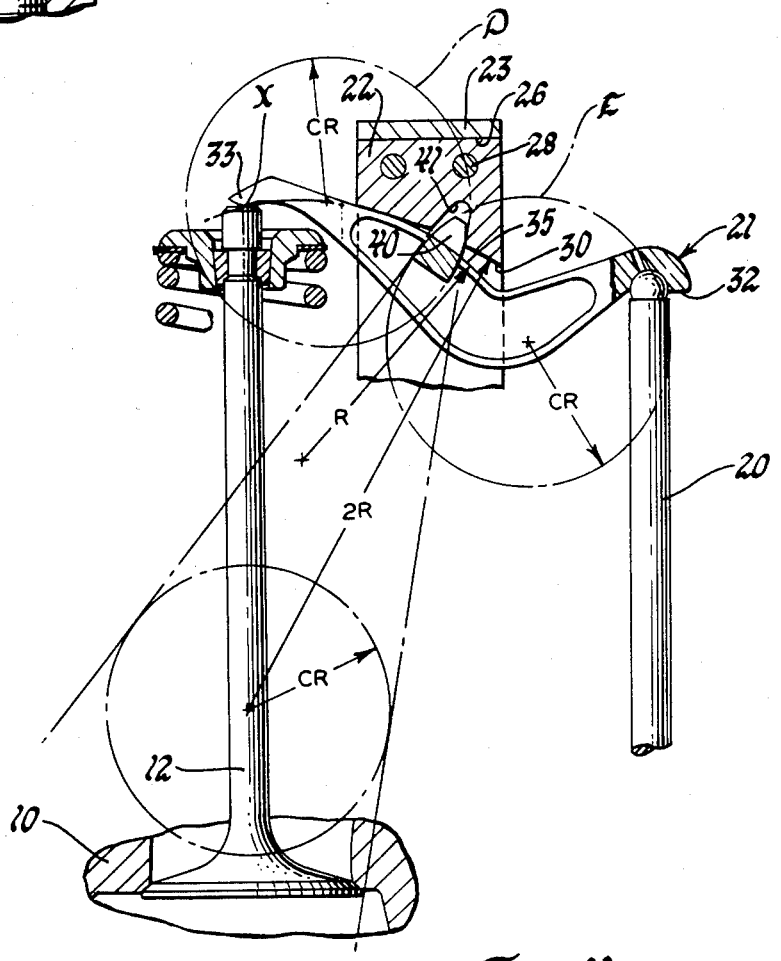
FIG. 4 is a pictorial view of the valve train of FIG. 2 showing the geometry of the valve train in accordance with the invention.

Now in accordance with a feature of the invention, the bearing surface 30 of the fulcrum 22 with a radius 2R is positioned so that the center of revolution of this bearing surface is located on the operating axis of the associate poppet valve 12, as shown in FIG. 4. In addition, the bearing surface 35 of a radius R is located and the arm 33 is so configured, whereby an extension of the bearing surface 35, as shown in FIGS. 2 and 4, will intersect the contact point X of the lower surface of the arm 33 onto the axis of the associate poppet valve 12 at the upper free end thereof.

With this arrangement, wherein the bearing surface 30, of a radius 2R defines an outer conformation, the bearing surface 35 defines an inner conformation, during pivotal movement of the rocker arm 21, the bearing surface 35 of the rocker arm 21 will be in rolling contact with the bearing surface 30 of the associate fulcrum 22. The relative rolling contact between these bearing surfaces 30, 35 having a radii ratio of 2:1 is a special case hypocycloid often referred to as cardanic motion. Cardanic motion is the plane motion of a circle or cylinder rolling inside another circle or cylinder, respectively, twice its size without slippage at the contact point between these elements. Thus in the embodiment of the rocker arm and fulcrum shown, the cardanic motion is obtained by having the radii of curvature of these fixed and moving centrodes in the ratio of 2:1, with the centrodes lying on the same side of a common tangent. With this ratio of the radii of 2:1 to obtain cardanic motion, a point on the circumference of the rolling circle or cylinder will be in a straight line extending through the center of the outside circle or cylinder. Thus, the hypocycloid for this special case in which the inner circle or cylinder is one half the diameter of the outer circle or cylinder is a straight line passing through the center of the outer circle or cylinder.

Accordingly, since the point X on the rocker arm 21 is located, in effect, on the effective circumference of the rolling cylinder, that is, the bearing surface 35 of rocker arm 21, movement of this point X will be in a straight line extending through the center of the outer cylinder, that is the center of revolution defining the bearing surface 30 of fulcrum 22, which center, as described hereinabove, is located on the reciprocating axis of the associate poppet valve 12. Thus during engine operation, a straight line force is applied by the arm 33 on the associate poppet valve 12, a line which corresponds to the reciprocating axis of this valve. Thus the rocker arm 21 will produce straight line-zero scrub motion at the rocker arm-valve stem contact point X.

In order to insure substantial rolling contact of the rocker arm 21 on its associate fulcrum 22, the rocker arm 21 is provided with raised retainer pins or teeth 40 located on opposite sides of the bearing surfaces 35 thereof which are adapted to operate in tapered guide slots 41 provided in each of the retainer arms 31 of the fulcrum 22.

As best seen in FIG. 4, the centers of the slots 41 lie on a plane that extends from the center of revolution of the bearing surface 30 through the point of line contact of the bearing surface 35 on the bearing surface 30 at the mean position of the rocker arm 21, that is, in its travel from the valve closed position shown in FIGS. 2 and 4 to a full valve open position.

Now in accordance with another feature of the invention, the special straight line hypocycloid is utilized to simplify the shape and to thus reduce the manufacturing cost of the locating pin and slot and this construction is graphically illustrated in FIG. 4. By way of example, the configuration of each retainer pin and its associate slot will be described herein using the dimension of a rocker arm and pivot structure used in a particular internal combustion engine application.

Thus in this particular rocker arm and pivot application, the radius 2R of the bearing surface 30 on the fulcrum 22 was 88.9 millimeters and, accordingly the radius R of the bearing surface 35 on the associate rocker arm 21 was 44.45 millimeters.

Referring now to the retainer pin 40 configuration, the opposed sides of the retainer pin are of semi-cylindrical configuration, that is, as shown in FIG. 4, they are segments on circles D and E of a radius CR of 25 millimeters, with the centers thereof located on the curved plane conforming to an extension of the bearing surface 35 of the rocker arm 21.

Accordingly, then the centers of these circles D and E will travel along straight lines through the center of the outer conformation, that is, through the center of the bearing surface 30.

It therefore follows that the tangents of the circles D and E that parallel the paths of the centers of these circles D and E are always the same straight lines, which thus permits the opposed sides of an associate guide slot 41 to be straight lines.

Thus the opposed surfaces of a guide pin 40 are semicircular and the opposed sides of an associate slot 41 are straight lines as viewed in the construction illustrated in FIGS. 2 and 4, with these sides preferably being interconnected by a curved wall of suitable radius, as desired. As shown in FIG. 4, the opposed straight wall sides of each slot 41 are thus lined in planes that are tangent to a circle of a construction radius CR of 25 millimeters, the center of revolution of this circle corresponding to the center of revolution of the bearing surface 30 that is located on the reciprocating axis of the associate poppet valve 12.

As will be apparent to those skilled in the art, the centers of the circles D and E are located so as to provide a retainer pin of suitable width and thus of a suitable strength for a given application. Thus in the construction described, the centers of the circles D and E were located so as to provide for a width across the retainer pin 40, at the bearing surface 35 location of this pin, of approximately 5.60 mm. It will be apparent that the spacing between the set of retainer pins 40 on a rocker arm 21 is selected so as to be greater than the width of the bearing surface 30 of the associate fulcrum 22 so as to permit rolling contact engagement between the bearing surfaces 30 and 35 as shown in FIG. 3.

As should now be apparent, the retainer pins 40 and associate slots 41 will not only insure substantially rolling contact of the rocker arm 21 on its associate fulcrum 22 but will also maintain the correct alignment of these elements.

The advantages of the hypocyclic rolling contact rocker arm and pivot of the subject invention are as follows:

1. The rolling friction between the rocker arm and its stationary fulcrum is less than the sliding friction of conventional rocker shafts or ball pivots.

2. The zero scrub straight line actuation of the subject rocker arm effectively eliminates the scrub losses at the rocker arm-valve stem interface.

3. True straight line actuation of the valve eliminates the kinematic side loads on the valve guide. This has the following advantages:

a. Reduced friction losses in the valve guide.
b. This in turn permits use of smaller diameter valve stems further reducing valve guide losses, and proportionally lowering valve guide seal losses.
c. Smaller valve stems lower the valve mass, which permits lower valve return spring force, lowering the losses through the entire valve train.

Figure 5:
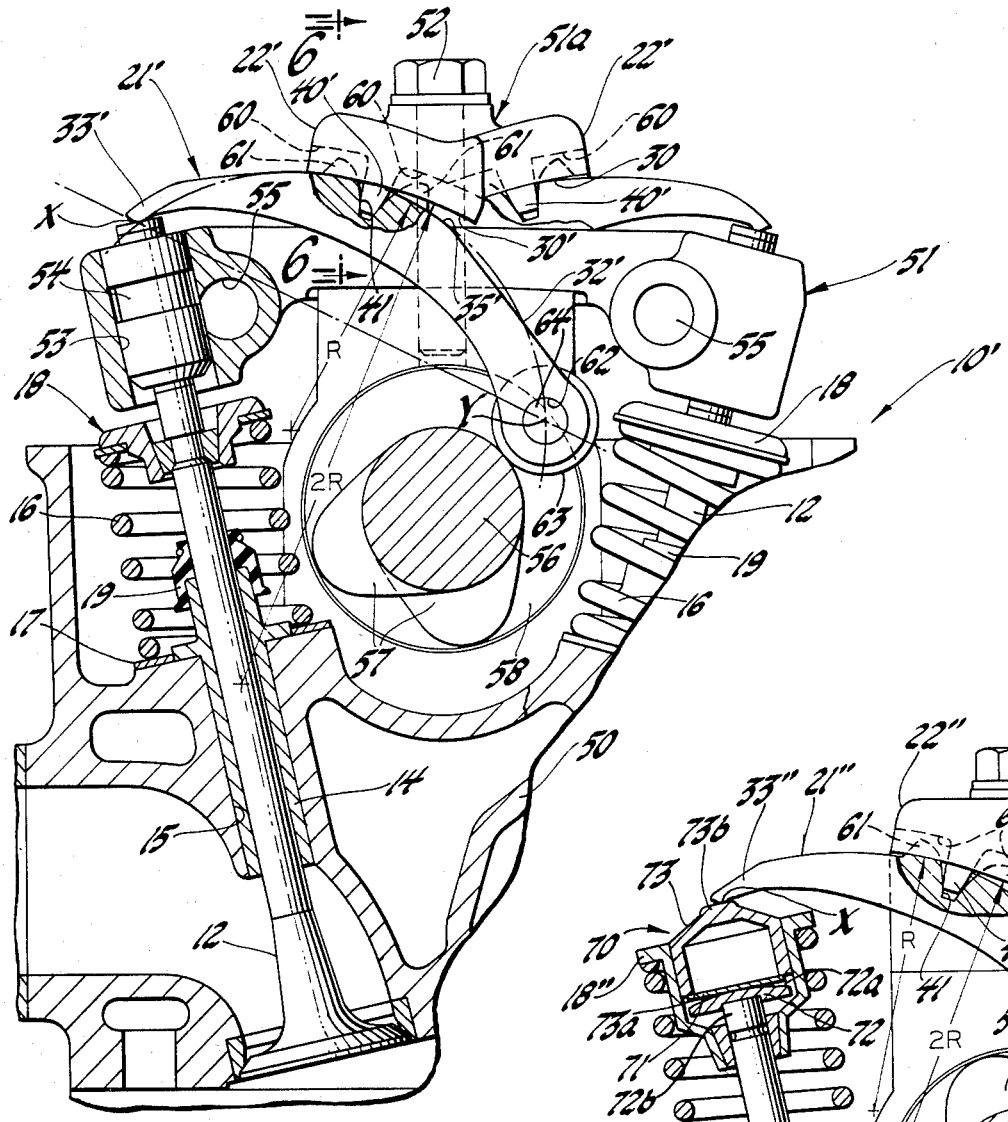
FIG. 5 is a transverse, vertical sectional view of a portion of an overhead cam type internal combustion engine, with the valve cover removed, having a valve train in accordance with the invention incorporated therein with this embodiment using a hydraulic valve lifter.
Figure 7:
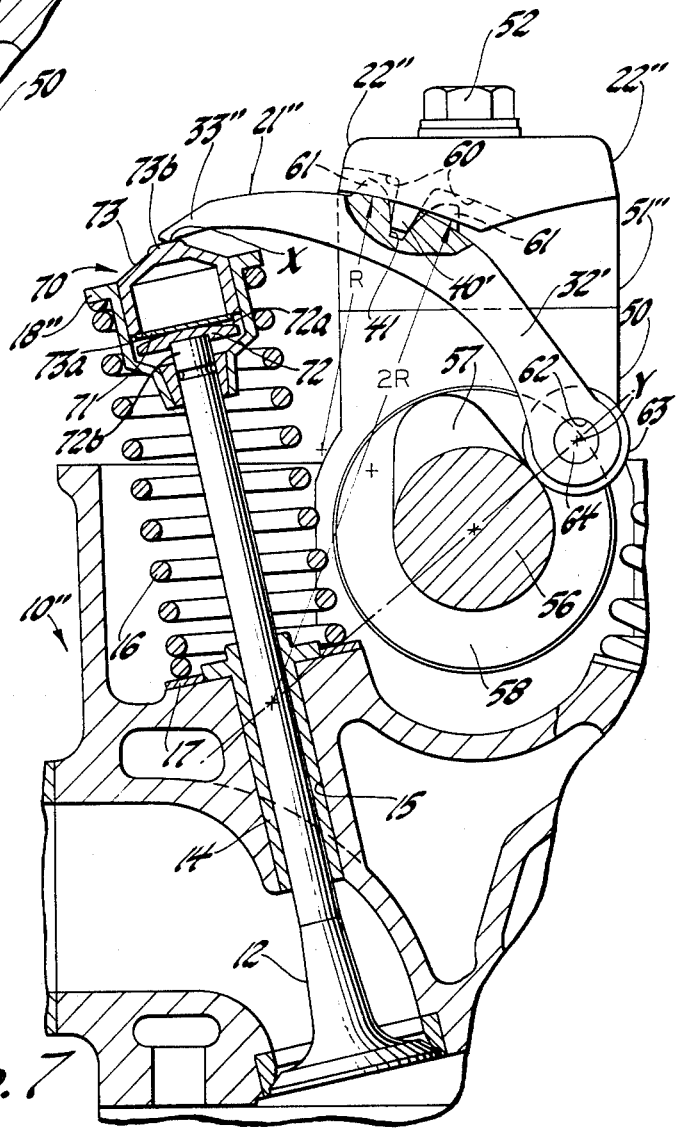

FIGS. 5 and 7 are illustrations of an alternate embodiment of a hypocyclic rolling contact rocker arm and pivot, in accordance with a feature of the invention that is constructed for use in an overhead cam engine, with similar parts being designated by similar numerals but with the addition of a prime (') where appropriate. The rocker arm in the engine arrangement shown in FIG. 5 actuates an associate poppet valve via a hydraulic lifter whereas in the engine arrangement shown in FIG. 7, the rocker arm actuates the associate poppet valve via a mechanical lifter.

Referring now to FIG. 5, there is shown a portion of an overhead cam type internal combustion engine having a multiple piece cylinder head 10', which, in the construction shown, includes a lower cylinder head element 50 and an upper cylinder head element 51 suitably secured together as by screws 52, only one of which is shown.

In the construction shown in this embodiment, the upper cylinder head element 51 is provided with suitable bores 53, each of which is aligned coaxial with the reciprocating axis of a poppet valve 12 journaled in the lower cylinder head element 50. Each bore slidably receives a suitable, conventional type hydraulic lash adjuster or lifter 54 operatively positioned between the free end of the stem of an associate poppet valve 12 and the end of an associate rocker arm 21' that is pivotably supported by means of an associate fulcrum 22' on a pedestal portion **51*a* formed integral with the upper cylinder head element 51. As shown, the upper cylinder head 51 is also provided on opposite sides thereof with longitudinal extending oil galleries 55 for supplying hydraulic fluid, such as engine lubricating oil, to the hydraulic valve lifters 54** in a conventional manner known in the art.

With the V configuration of the inlet and exhaust poppet valves 12 in the engine construction shown in FIG. 5, these valves are operated from a single camshaft 56 that extends longitudinally of the engine above the associated cylinders, not shown, and that is located transversely between the stems of the inlet and exhaust poppet valves 12 with its axis of rotation preferably positioned, in accordance with a feature of the invention, in a manner to be described in detail hereinafter.

Camshaft 56 has suitable cam lobes 57 located and oriented to effect operation of the poppet valves 12 of the engine. As would be conventional, the camshaft 56 is rotatably supported by bearings, not shown, which are suitable supported on longitudinally spaced webs 58 formed integral with the upper cylinder head element 51 and is driven in timed relationship to the rotation of the engine crankshaft by conventional means, not shown.

As shown, each fulcrum 22', such as the left hand fulcrum for the inlet poppet valve 12 with reference to FIG. 5, is provided with a lower semi-cylindrical, concave bearing surface 30' of a suitable predetermined radius 2R and, in the construction illustrated, with grooves 60 therein on opposite sides of a depending retainer pin or tooth 40'.

Each rocker arm 21', such as the rocker arm for the inlet poppet valve 12, as best seen in FIG. 5, is provided with arms 32' and 33' overlying the camshaft 56 and associate poppet valve 12, respectively. Between the arms 32' and 33', each rocker arm 21' is provided with an upper, intermediate, semi-cylindrical convex bearing surface 35' of a radius R and, with spaced apart teeth 61 to define therebetween a guide slot 41'.

Figure 6:
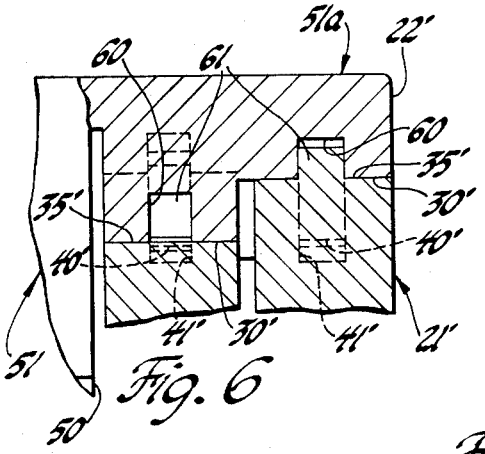
FIG. 6 is a cross-sectional view taken along line 6—6 of FIG. 5 showing the rocker arms and fulcrums for the inlet and exhaust valves for a cylinder of the engine; and, FIG. 7 is a transverse, vertical sectional view similar to FIG. 5 but showing the valve train used with an alternate embodiment valve lifter.

The width of the teeth 61 relative to the width of grooves 60 and, the width of the retainer tooth 40' relative to the width of the guide slot 41', are preselected, as desired, whereby the teeth 61 and tooth 40' are slidably received in the grooves 60 and guide slot 41', respectively, as best seen in FIG. 6. In addition, the widths of the bearing surfaces 30' and 35' are formed complementary to each other, as desired, to provide for suitable engagement therebetween for a particular engine application.

As should now be apparent from the structure shown in FIG. 6, each pedestal portion **51*a* can be provided with a set of fulcrums 21' for the inlet and exhaust valves of a cylinder at opposite ends thereof and, that plural spaced apart pedestal portions 51*a* can be provided on the upper cylinder head 51** as desired for a given engine application.

In a manner and for the same purpose previously described with reference to the embodiment shown in FIGS. 1–4, the bearing surface 30' of the fulcrum 22' with a radius 2R is positioned so that the center of revolution of this bearing surface is located on the operating axis of the associate poppet valve 12. In addition, the rocker arm 21' is configured whereby an extension of the bearing surface 35' thereon, as shown in FIG. 5, will intersect the contact point X of the lower surface of the arm 33' onto the upper end of the hydraulic valve lifter 54 at a point corresponding to the reciprocating axis of the associate poppet valve 12.

Now in accordance with another feature of the present invention, the opposite arm 32' of the rocker arm 21' is bifurcated and is provided with an aperture therethrough, as at 62 whereby to receive a roller cam follower 63 rotatably supported on a shaft 64 fixed in the aperture 62, with the axis of the shaft 64, and thus the axis Y of rotation of the cam follower 63, being also located, in effect, on an extension of the bearing surface 35' as best seen in FIG. 5.

In addition, the axis Y of the shaft 64, and thus the axis of rotation of the cam follower 63 and, the axis of rotation of the camshaft 56 are preferably positioned so as to be in a plane that intersects the center of revolution of the bearing surface 30', as shown in FIG. 5, for a purpose to be described in detail hereinafter.

With this arrangement, wherein the bearing surface 30', of a radius 2R defines an outer conformation and the bearing surface 35' defines an inner conformation of radius R during pivotal movement of the rocker arm 21', the bearing surface 35' of the rocker arm 21' will be in rolling contact with the bearing surface 30' of the associate fulcrum 22' in the same manner as previously described with reference to the embodiment of FIGS. 1–4.

Also as previously described, the relative rolling contact between these bearing surfaces 30', 35' having a radii ratio of 2:1 is a special case hypocycloid often referred to as cardanic motion which is the plane motion of a circle or cylinder rolling inside another circle or cylinder, respectively, twice its size without slippage at the contact point between these elements. Thus in the embodiment of the rocker arm and fulcrum shown in FIG. 5, the cardanic motion is obtained by having the radii of curvature of these fixed and moving centrodes, 30' and 35', respectively in the ratio of 2:1.

Thus as described, with this ratio of the radii of 2:1 to obtain cardanic motion, a point on the circumference of the rolling circle or cylinder will be in a straight line extending through the center of the outside circle or cylinder. Thus, the hypocycloid for this special case in which the inner circle or cylinder is one half the daimeter of the outer circle or cylinder is a straight line passing through the center of the outer circle or cylinder, that is, through the center of revolution of the bearing surface 30'.

Now, since the point X on the rocker arm 21' is located, in effect, on the effective circumference of the rolling cylinder, that is, the bearing surface 35' of rocker arm 21', movement of this point X will be in a straight line extending through the center of the outer cylinder, that is the center of revolution defining the bearing surface 30' of fulcrum 22', which center, as described hereinabove, is located on the reciprocating axis of the associate poppet valve 12 and of the hydraulic lifter 54. Thus during engine operation, a straight line force is applied by the arm 33' on the associate poppet valve 12 via the hydraulic lifter 54, a line which corresponds to the reciprocating axis of the poppet valve 12. Thus the rocker arm 21' will produce straight line-zero scrub motion at the rocker arm-valve stem contact point X.

In addition, with the axis Y of rotation of the cam follower 63 also located, in effect, on an extension of the bearing surface 35' of rocker arm 21' and if, in effect, on a line passing through the axis of rotation of the camshaft 56 and the center of revolution defining the bearing surface 30', there will be substantially no skidding force on the rocker arm 21' due to contact between its cam follower 63 and the associate lobe 57 on the camshaft 56.

In addition, the engagement of the tooth 40' in the guide slot 41' between teeth 111 on the rocker arm 21' will insure rolling contact of the bearing surface 35' on the bearing surface 30' and, in addition, this engagement of these elements and of the teeth 111 in groove 110 of the fulcrum 22', as best seen in FIG. 6, will prevent skewing of the associate rocker arm 21'.

An alternate embodiment of an overhead cam engine with a hypocyclic rolling contact rocker arm and pivot, in accordance with the invention is shown in FIG. 7, wherein similar parts are designated by similar numerals but with the addition of a double prime (") where appropriate.

In this embodiment, the overhead cam engine has a cylinder head 10" which, in the construction shown, includes a lower cylinder head element 50 with one or more upper cylinder head elements in the form of pedestals 51" secured thereto as by screws 52.

Each pedestal 51" is provided with at least one end thereof with a set of fulcrums 22" for the rocker arm 21" to effect actuation of the inlet and exhaust poppet valves for a cylinder, not shown, of the engine, only the inlet valve 12 and associate rocker arm 21" being shown. Also, in order to simplify this drawing FIG. 7, only the cam lobe 57 for the inlet valve is shown on camshaft 56.

In this embodiment, a suitable, conventional mechanical lifter or mechanical expansion compensating device generally designated 70, is operatively positioned between the free end of an associate poppet valve 12 and arm 33" of its associate rocker arm 21".

By way of an example, the mechanical expansion compensating device 70, in the construction shown, as of the type disclosed in U.S. Pat. No. 4,365,595, entitled Actuation of Valves of Internal Combustion Engines, issued Dec. 18, 1982, to Sanzio P. V. Piatti, and includes a metal spring disc 71 operatively positioned between a lower abutment member 72, an upper piston 73, and an elongated, cup-shaped, spring retainer 18".

As shown, the abutment member 72 has a head with a semi-spherical, convex upper surface **72*a* which abuts against the central lower surface of the spring disc 71 and a stem portion 72*b* which abuts the end of the stem of the associate poppet valve 12, with the head thereof loosely secured in the tubular shaped, spring retainer 18"**.

The piston 73, of inverted cup shape, is slidably journaled in the upper open end of the spring retainer 18" and is provided at its lower end with an annular, radially inward inclined end surface **73*a*, which is preferably of generally concave shape formed complementary to convex upper surface 72*a* of the abutment member 72, so as to abut against the upper surface of the spring disc 71 adjacent to its outer peripheral edge. For purrpose of illustration only, the spring disc 71 is shown flat, but it should be realized that at initial adjustment in an engine the spring disc 71** would be bent, as desired, to take up lash as necessary.

As shown, the piston 73 is also preferably provided with a central upstanding boss **73*b* on its upper or base end for engagement by the operating end of the arm 33' of the rocker arm 21'**.

In this FIG. 7 engine embodiment, the rocker arm 21" and fulcrums 22" on the predestal 51" are similar to those of FIGS. 5 and 6, previously described hereinabove, and, accordingly it is not deemed necessary to again describe these elements in detail.

While this invention has been described with reference to the particular embodiments disclosed herein, it is not confined to the details set forth since it is apparent that various modifications can be made by those skilled in the art without departing from the scope of the invention. This application is therefore intended to cover such modifications or changes as may come within the purposes of the invention as defined by the following claims.

The embodiments of the invention in which an exclusive property or privilege is claimed are defined as follows:

1. A reciprocating internal combustion engine of the type having an engine block defining a cylinder with a port, a valve located for axial movement in said port and biased to a predetermined position, an overhead camshaft spaced from the valve and operable to effect reciprocation of the valve, and a rocker arm in operative engagement via a lifter with the valve and having a roller follower rotatably journaled thereon for engagement with the camshaft whereby the rocker arm is actuated in rocking movement to reciprocate said valve against said bias to open and close the port for engine operation, the improvement comprising:

fulcrum means defining a fixed rocking support intermediate the length of the rocker arm, said fulcrum means and said rocker arm defining a pair of cooperating outer and inner cylindrical bearing surface contours, respectively, carrying the reaction forces of rocker arm pivotal movement, the radius of the outer bearing surface being substantially two times the radius of the inner bearing surface, with the geometric center of the outer bearing surface being located on the operating axis of said valve, the inner bearing surface of said rocker arm being located such that an extension thereof will intersect the contact point of said rocker arm on the lifter at the axis of said valve at the free end thereof and will intersect the axis of rotation of said roller follower; the axis of rotation of said roller follower and of said camshaft lying in a plane that extends through the geometric center of the outer bearing surface;

restrainer means to anchor the cooperating cylindrical bearing surfaces for substantially rolling action in relation to each other, said restrainer means comprising a retainer pin means associated with one of said bearing surfaces and a slot means associated with the other one of said bearing surfaces of a size to receive said pin, whereby within the range of rocker arm oscillation said retainer pin means establishes substantially rolling contact between the cylindrical surfaces by contact with the guide surfaces of the recess.

2. A reciprocating internal combustion engine of the type having an engine block defining a cylinder with a port, a valve located for axial movement in said port and biased to a predetermined position, an overhead camshaft spaced from the valve and operable to effect reciprocation of the valve, and a rocker arm in operative engagement with a lifter located between the rocker arm and the valve and having a rotatable roller follower thereon for engagement with the camshaft whereby the rocker arm is actuated in rocking movement to reciprocate said valve against said bias to open and close the port for engine operation, the improvement comprising:

fulcrum means defining a fixed rocking support intermediate the length of the rocker arm, said fulcrum means and said rocker arm defining a pair of cooperating concave and convex cylindrical bearing surface contours, respectively, carrying the reaction forces of rocker arm pivotal movement, the radius of the concave bearing surface being substantially two times the radius of the convex bearing surface, with the geometric center of the concave bearing surface being located on the operating axis of said valve, the convex bearing surface of said rocker arm being located such that an extension thereof will intersect the contact point of said rocker arm on the axis of said valve at the free end thereof and will intersect the axis of rotation of said roller follower; the axis of rotation of said roller follower and of said camshaft being located so that a line therethrough will extend so as to intersect the geometric center of the concave bearing surface; and, restrainer means to anchor the cooperating cylindrical bearing surfaces for substantially rolling action in relation to each other, said restrainer means comprising a retainer pin means associated with one of said bearing surfaces and a slot means associated with the other one of said bearing surfaces of a size to receive said pin.

3. A reciprocating internal combustion engine of the type having an engine block defining a cylinder with a port, a valve located for axial movement in said port and biased to a predetermined position, an overhead camshaft spaced from the valve and operable to effect reciprocation of the valve, and a rocker arm in operative engagement with a lifter sandwiched between the rocker arm and valve, said rocker arm having a rotatable roller follower thereon for rolling engagement with the camshaft whereby the rocker arm is actuated in rocking movement to reciprocate said valve against said bias to open and close the port for engine operation, the improvement comprising:

fulcrum means defining a fixed rocking support intermediate the length of the rocker arm, said fulcrum means and said rocker arm defining a pair of cooperating outer and inner cylindrical bearing surface contours respectively, carrying the reaction forces of rocker arm pivotal movement, the radius of the outer bearing surface being substantially two times the radius of the inner bearing surface, with the geometric center of the outer bearing surface being located on the operating axis of said valve, the inner bearing surface of said rocker arm being located such that an extension thereof will intersect the contact point of said rocker arm on the axis of said valve at the free end thereof and will intersect the axis of rotation of said roller follower; the axis of rotation of said roller follower and of said camshaft lying in a plane that extends through the geometric center of the outer bearing surface;

restrainer means to anchor the cooperating cylindrical bearing surfaces for substantially rolling action in relation to each other and to prevent skewing of the said rocker arm, said restrainer means comprising a groove means on opposite sides of a retainer pin means on said fulcrum means and spaced apart teeth on said rocker arm defining slot means therebetween of a size to receive said pin and with said teeth slidable in said groove means.

4. An overhead cam type reciprocating internal combustion engine having a cylinder head with a valve journaled therein for axial movement between a valve open and a valve closed position, a lifter operatively positioned to engage the stem end of the valve, an overhead camshaft journaled in the cylinder head for rotation about an axis, and a rocker arm in operative engagement with the lifter and having a roller follower thereon for rotation about an axis and positioned to engage the camshaft whereby the rocker arm is actuated in rocking movement to reciprocate said valve for engine operation, the improvement comprising:

fulcrum means in said cylinder head to define a fixed rocking support intermediate the length of the rocker arm, said fulcrum means and said rocker arm defining a pair of cooperating outer and inner cylindrical bearing surface contours respectively, carrying the reaction forces of rocker arm pivotal movement, the radius of the outer bearing surface being substantially two times the radius of the inner bearing surface, with the geometric center of the outer bearing surface being located on the operating axis of said valve, the inner bearing surface of said rocker arm being located such that a circular plane extension thereof will intersect the contact point between said lifter and said rocker arm on the reciprocating axis of said valve and will also intersect the axis of rotation of said roller follower; the axis of rotation of said roller follower and the axis of said camshaft lying in a plane that extends through the geometric center of the outer bearing surface; and, restrainer means to anchor the cooperating cylindrical bearing surface for substantially rolling action in relation to each other and to prevent skewing of said rocker arm relative to said fulcrum means.

* * * * *